US011801431B2

(12) United States Patent
Walker, Jr.

(10) Patent No.: US 11,801,431 B2
(45) Date of Patent: Oct. 31, 2023

(54) SHOT MAKING TRAINING APPARATUS

(71) Applicant: Lenard E. Walker, Jr., Detroit, MI (US)

(72) Inventor: Lenard E. Walker, Jr., Detroit, MI (US)

( * ) Notice: Subject to any disclaimer, the term of this patent is extended or adjusted under 35 U.S.C. 154(b) by 19 days.

(21) Appl. No.: 17/443,958

(22) Filed: Jul. 29, 2021

(65) Prior Publication Data

US 2022/0032152 A1 Feb. 3, 2022

Related U.S. Application Data

(60) Provisional application No. 62/706,062, filed on Jul. 30, 2020.

(51) Int. Cl.
*A63B 69/00* (2006.01)
*A63B 63/08* (2006.01)

(52) U.S. Cl.
CPC ..... *A63B 69/0071* (2013.01); *A63B 63/083* (2013.01); *A63B 2208/12* (2013.01); *A63B 2210/50* (2013.01); *A63B 2225/093* (2013.01)

(58) Field of Classification Search
CPC ..... A63B 69/0071; A63B 63/083; A63B 2243/0037; A63B 63/00; A63B 2208/12; A63B 2210/50; A63B 2225/093
See application file for complete search history.

(56) References Cited

U.S. PATENT DOCUMENTS 1,211,379 A * 1/1917 Maisch ..... A63F 9/02 273/400
1,628,364 A * 5/1927 Hiett ..... A63B 63/083 473/480
2,194,779 A * 3/1940 Albach ..... A63B 63/08 473/485
2,278,616 A * 4/1942 Kettering ..... A63B 63/083 200/332
2,301,265 A * 11/1942 Fandrey ..... A63F 7/0612 273/342
2,534,067 A * 12/1950 Rubin ..... A63B 63/083 473/487
2,694,572 A * 11/1954 Crisp ..... A63B 63/083 473/449
3,264,001 A * 8/1966 Urban ..... A63B 63/00 473/196

(Continued)

*Primary Examiner* — Melba Bumgarner
*Assistant Examiner* — Amir A Klayman
(74) *Attorney, Agent, or Firm* — William J. Clemens; Shumaker, Loop & Kendrick, LLP

(57) ABSTRACT

An athletic skill training apparatus includes a generally horizontal upper ring that defines an upper opening, preferably circular and the same diameter as a traditional basketball hoop, made from a strong, lightweight material. Three lower rings are attached to the upper ring and extend downwardly and inwardly to attach to a base plate. A shock absorbing base member is elastically suspended from the lower rings and absorbs a portion of the force from a ball shot through the upper ring. The base member includes vertically spaced concentric rings of different diameters to redirect the ball out of the lower rings. The rings, the shock absorbing base member and the base plate form a goal assembly that can be positioned on a support above a playing surface.

10 Claims, 10 Drawing Sheets

(56) References Cited

U.S. PATENT DOCUMENTS 3,328,033 A * 6/1967 Hendry ..... A63B 63/00 273/127 R
3,421,764 A * 1/1969 Smith ..... A63B 63/08 473/485
3,602,505 A * 8/1971 Friend ..... A63B 69/407 273/400
4,768,784 A * 9/1988 Wilson ..... A63B 69/0097 473/454
4,877,241 A * 10/1989 Rothbard ..... A63B 63/083 473/485
5,069,441 A * 12/1991 Fang ..... A63B 63/083 473/485
5,443,258 A * 8/1995 Kinsella ..... A63B 69/0071 473/433
5,575,481 A * 11/1996 Lovetere ..... A63B 69/0079 473/430
5,692,979 A * 12/1997 Jones ..... A63B 63/08 473/472
5,944,318 A * 8/1999 Payton ..... A63B 63/00 473/476
6,083,114 A * 7/2000 Bailey ..... A63B 57/357 473/196
6,458,048 B1 * 10/2002 McGrath ..... A63B 69/0002 473/456
6,652,396 B2 * 11/2003 McBride ..... A63B 63/083 473/485
6,659,466 B2 * 12/2003 Searles ..... A63B 63/00 273/400
6,692,385 B2 2/2004 Walker, Jr. et al.
6,733,403 B2 * 5/2004 Courtright ..... A63B 63/083 473/433
6,942,487 B2 * 9/2005 Corbalis ..... A63B 69/0093 472/91
7,066,824 B2 * 6/2006 Wenzler ..... A63B 69/3623 473/196
7,322,914 B1 * 1/2008 Vittone ..... A63B 23/025 482/146
7,448,969 B2 11/2008 Weber et al.
7,896,350 B2 3/2011 Harries
7,955,198 B1 * 6/2011 Vysosias ..... A63B 67/002 473/472
7,984,910 B1 7/2011 Nielsen
8,011,665 B2 * 9/2011 Stanley ..... A63B 63/00 273/400
8,083,654 B1 * 12/2011 MacDonald ..... A63B 21/0435 482/79
8,282,509 B1 * 10/2012 Michaelson ..... A63B 69/36 473/456
8,734,297 B2 * 5/2014 Chen ..... A63B 5/11 482/27
9,511,270 B2 12/2016 Berebitsky
10,434,365 B2 * 10/2019 Mack ..... A63B 21/0552
10,583,342 B1 3/2020 Williams
10,646,762 B2 * 5/2020 Bowers ..... A63B 63/00
2007/0135239 A1 * 6/2007 Manix ..... A63B 63/083 473/448
2018/0036584 A1 * 2/2018 Kleman ..... A63B 21/0557
2018/0085650 A1 * 3/2018 Dalton ..... A63F 13/428
2020/0030656 A1 * 1/2020 Hurlbut ..... A63B 23/03508
2020/0353340 A1 * 11/2020 Arredondo ..... A63B 69/215

* cited by examiner

SHOT MAKING TRAINING APPARATUS

CROSS-REFERENCE TO RELATED APPLICATIONS

This application claims the benefit of U.S. provisional patent application Ser. No. 62/706,062 filed Jul. 30, 2020.

FIELD OF THE INVENTION

This invention relates generally to an apparatus for providing sports training and, in particular, to a shot making training apparatus such as for basketball.

BACKGROUND OF THE INVENTION

An essential skill in basketball is the ability to make field goal, two point and/or three point, and free throw shots. Improving the accuracy of field goal and free throw shots, therefore, is a continuing desire of most basketball players. Shooting a basketball at a hoop by oneself in an effort to improve one's shot-making ability, however, can be a tedious task at best and time-consuming and inefficient at worst. Missed shots are always a problem because the balls must be chased down. Successful shots, though, are also a problem because the net is designed to cause the ball to drop to the playing floor immediately below the rim. A player then is forced to move from his or her shooting location to the basket in order to retrieve the ball and then move to another shooting location, which is inefficient and time-consuming. A subsequent successful shot means the process outlined above begins again.

The art has recognized these practice deficiencies and has provided numerous devices for improving the accuracy of a player's shots. Many of these devices are disadvantageously designed to be attached to basketball rims, limiting the use of the device to locations having an installed basketball rim. Those devices that are not designed to be attached to existing basketball rims are often bulky and difficult to transport and assemble. Other types of practice devices are targets or goals that reward the user for successful shots, and/or reduce the area of the hoop through which the basketball must pass, such as concentric hoops for improving accuracy. Many devices include a means to return the ball to the user after completion of a successful shot by the use of ramps, chutes or the like directing the ball to a single designated spot adjacent the basketball goal with the purpose of making shooting practice time more efficient. These devices return the ball to the same location after a successful shot thereby rendering them useless in practicing shots from other locations. Furthermore, in actual playing conditions, basketball shots are often taken while moving. Another essential skill in basketball, therefore, is the ability to move laterally, which is not an element of the prior art basketball training devices.

It is desirable, therefore, to provide an apparatus for providing training to basketball players that will work on a player's shot-making ability and lateral movement. Such apparatus can be used in any other type of shot making game or skill contest. It is also desirable to provide a shot making training apparatus that is portable, lightweight, and easy to use. It is also desirable to provide a shot making training apparatus that may be used by young children as well as adults. It is also desirable to provide a shot making training apparatus that is easy to assemble, disassemble, and transport.

SUMMARY OF THE INVENTION

The invention concerns a shot making training apparatus and method for improving a player's shot and the player's lateral movement. The training apparatus includes a generally horizontal upper ring that defines an upper opening of a goal assembly. The ring is preferably circular and the same diameter as a traditional basketball hoop and is constructed of a lightweight material that is both strong and light including, but not limited to, aluminum, high-strength injection molded plastic materials, and the like. Three lower rings are attached at respective tangential points to the horizontal ring and extend downwardly and inwardly therefrom to attach at another respective tangential point to a base member. The upper ring, the lower rings, and the base member form a goal assembly. The lower rings are preferably the same diameter and constructed of the same material as the upper ring. However, the upper ring and the lower rings can be of any suitable size and shape depending upon the game to be played or the skill contest. A shock absorbing member is suspended above the base member and includes several vertically spaced concentric rings connected together as a ring assembly. Elastic cords extend between the lower rings and the ring assembly to absorb the force of the ball upon impact and facilitate the ball to exit the lower openings rather than impacting the surface of the base member and rebounding out the upper opening.

A lower surface of the base member is adapted to be attached to an upper portion of an elongated, telescoping pole. The pole is adjustable in length from a retracted lower position, suitable for use with children, to an extended position, such as a regulation ten foot height, to be used by taller children and adults alike. The lower portion of the pole is operable to be mounted to the ground or a playing surface.

In operation, the apparatus according to the invention is assembled and adjusted to the desired height. The player shoots the ball with the objective of passing the ball through the upper ring defining the upper opening of the goal assembly. When a successful shot is made, the ball will fall onto the shock absorbing member. Depending on where the ball contacts the ring assembly, the ball will be directed to exit one of the respective lower openings. The ball may pass through one of the openings so that the ball is returned close to the shot release point. The ball may also pass through either of the other two openings, which will force the player to move laterally to retrieve the ball in order to take another shot.

The training apparatus according to the invention thus places a premium on a player's shot-making ability, but also improves a player's lateral movement. A player can practice stationary shots, both jump shots and free throws, as well as practice the ability to make a successful shot while moving laterally, simulating real-game situations. The training apparatus provides repetition necessary to develop an improved shot. The training apparatus is advantageously lightweight, easy to assemble and does not require the use of an existing backboard and rim assembly.

A method of using the training apparatus according to the invention for training and/or game playing can be practiced by: (a) providing a goal assembly according to the present invention; (b) providing a ball to a player; (c) shooting the ball for a predetermined number of shots from one or more locations; and (d) tabulating a score based on at least one of the number of successful shots per attempted shots, the number of successful shots made in a row, and location of the ball as it exits the goal assembly.

While the training apparatus according to the invention is useful for training basketball players, it can be utilized with other types of balls for playing a variety of games and skill contests.

DESCRIPTION OF THE DRAWINGS

The above as well as other advantages of the invention will become readily apparent to those skilled in the art from the following detailed description of a preferred embodiment when considered in the light of the accompanying drawings in which:

FIGS. 1 through 8 are reproduced from U.S. Pat. No. 6,692,385 B2.

FIG. 1 is an exploded perspective view of a prior art training apparatus;

FIG. 2 is top plan view of the apparatus in FIG. 1 in an assembled configuration;

FIG. 3 is a top plan view of the shock absorbing base member shown in FIG. 2;

FIG. 4 is a side elevation view of the base member of FIG. 3;

FIG. 6 is a perspective view of the training apparatus of FIG. 1 shown attached to a self-righting base member;

FIG. 7 is a perspective view of the training apparatus of FIG. 1 shown attached to an alternative embodiment self-righting base member;

FIG. 8 is a perspective view of the training apparatus of FIG. 5*b* shown in use with a basketball and player

DESCRIPTION OF THE PREFERRED EMBODIMENT

The U.S. provisional patent application Ser. No. 62/706,062 filed Jul. 30, 2020 and the U.S. Pat. No. 6,692,385 B2 issued Feb. 17, 2004 are incorporated herein by reference.

The following detailed description and appended drawings describe and illustrate various exemplary embodiments of the invention. The description and drawings serve to enable one skilled in the art to make and use the invention, and are not intended to limit the scope of the invention in any manner. In respect of the methods disclosed, the steps presented are exemplary in nature, and thus, the order of the steps is not necessary or critical.

Figure 1:
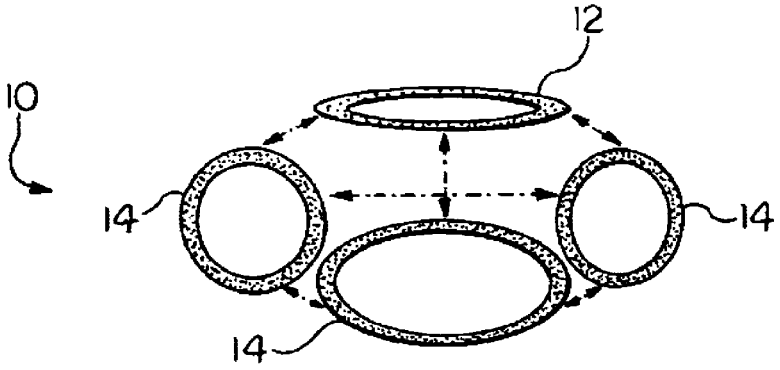
FIG. 1 (PRIOR ART)

Referring now to FIG. 1, a training apparatus according to the prior art (U.S. Pat. No. 6,692,385 B2) is indicated schematically at 10. The training apparatus 10 includes an upper ring 12 and a plurality of lower rings 14. Preferably, the upper ring 12 and the lower rings 14 are circular and of the same diameter as a regulation basketball hoop (typically 18 inches). However, the upper ring 12 and the lower rings 14 can be of any suitable size and shape for playing games and skill contests with different size balls or other objects. The upper ring 12 defines an upper opening and each of the lower rings 14 defines a respective lower opening extending therethrough. The upper ring 12 and the lower rings 14 are preferably constructed of a lightweight material that is both strong and light including, but not limited to, aluminum, high-strength injection molded plastic materials, and the like.

Figure 2:
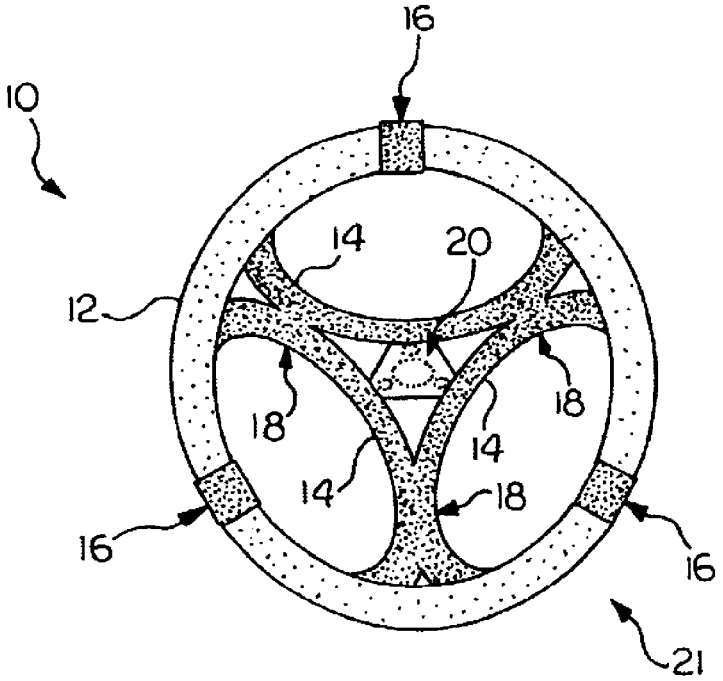
FIG. 2 (PRIOR ART)

Referring now to FIG. 2, the upper ring 12 is shown attached to each of the lower rings 14 at respective tangential points by respective attachment members 16. The attachment members 16 are preferably hook and loop straps or similar releasable attachment means. Each of the lower rings 14 is attached to the adjacent lower ring 14 by respective attachment members 18. The attachment members 18 are preferably hook and loop straps or similar releasable attachment means. When attached, the upper ring 12 extends in a horizontal plane and each of the lower rings 14 extends downwardly and inwardly from the upper ring 12 to attach to a shock absorbing base member 20 at a bottom portion of the lower rings. In the alternative, the rings 12, 14 and the base member 20 can be fixedly attached by adhesive, bonding, welding, and other known methods.

Figure 3:
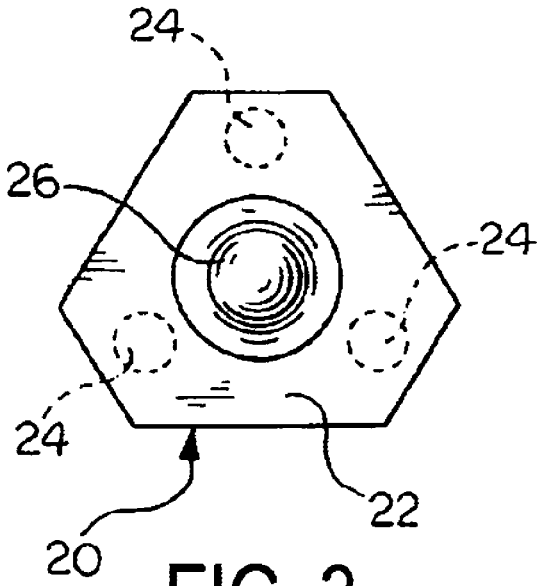
FIG. 3 (PRIOR ART)

Referring now to FIG. 3, a top plan view of the base member 20 is shown. The base member 20 includes an upper plate 22 and a lower plate 32 preferably connected by a shock absorbing means such as a plurality of springs 34 interposed between a lower surface of the upper plate 22 and an upper surface of the lower plate 32. Alternatively, the upper plate 22 and the lower plate 32 are connected by a plurality of dampers 36, or by a combination of both springs 34 and dampers 36. The damper 36 can be any suitable device such as a fluid filled shock absorber or a body of resilient material. The base member 20 includes a projection 26 extending upwardly from a center portion of the upper surface of the plate 22. The projection 26 includes a rounded upper surface 28 and a side surface 30 that tapers downwardly and outwardly to the upper surface of the plate 22. The upper surface of the plate 22 also includes a plurality of attachment points 24 for attaching the lower rings 14 to the base member 20. The upper ring 12, the lower rings 14, and the base member 20, when connected together, form a goal assembly indicated generally at 21 in FIG. 2. The lower plate 32 of the base member 20 is preferably operable to be attached to a mounting surface (not shown). While the rings 12 and 14 and the upper plate 22 have been described as being releasably attached, they can be permanently secured together. Also, the upper plate 22 can be used alone, to function as a shock absorber, as the base member 20.

Figure 4:
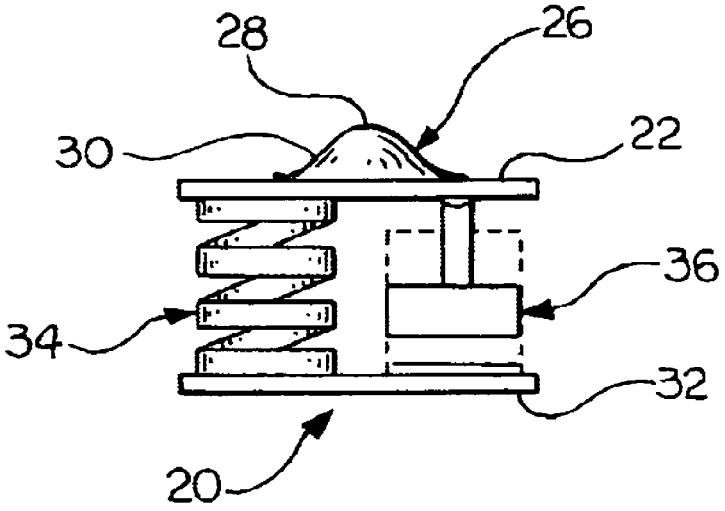
FIG. 4 (PRIOR ART)
Figure 5A:
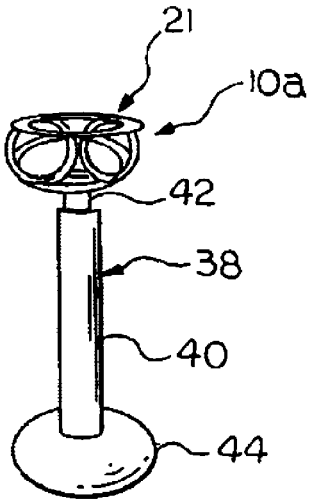
FIG. 5A (PRIOR ART)
FIG. 5*a* is a perspective view of the training apparatus of FIG. 1 shown attached to a rigid base member in a retracted position.
Figure 5B:
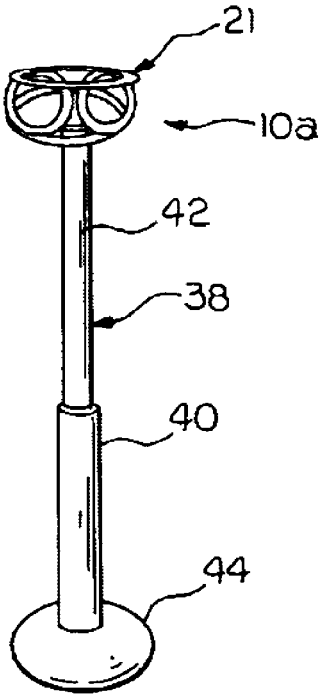
FIG. 5B (PRIOR ART)
FIG. 5*b* is a perspective view of the training apparatus and rigid base member of FIG. 5*a* in an extended position.

Referring now to FIG. 5*a* and FIG. 5*b*, a training apparatus 10*a* has the goal assembly 21 attached to an upper end of a vertically extending telescoping pole 38. The telescoping pole 38 includes an upper member 42 slidably received in a lower member 40. A lower end of the lower member 40 is attached to a ground engaging base or support member 44. The upper end of the upper member 42 is mounted to the lower surface of the lower plate 32 of the base member 20 shown in FIG. 4. The support member 44 is adapted to engage or be mounted on the ground or a playing surface (not shown) to provide support for the goal assembly 21 and the pole 38. The support member 44 may be filled with water or sand (not shown) in order make it more stable and withstand forces imposed on the goal assembly 21 and the pole 38 by contact with the ball or a player. The pole 38 is adjustable to move the goal assembly 21 from a lower, retracted position suitable for play by smaller children, best seen in FIG. 5*a*, to an upper, extended position suitable for play by taller children and adults, best seen in FIG. 5*b*.

The upper member 42 can be moved manually or can be spring biased (not shown) with suitable fastening means to retain the upper member in the selected position. Also, an electric motor and drive (not shown) can be used to raise and lower the goal assembly, and to rotate it if desired. Thus, the pole 38 and the support member 44 function as a support assembly retaining said upper ring 12 a predetermined distance above the ground. Further, the pole 38 can be positioned to extend horizontally relative to the ground with the goal assembly 21 attached with the same orientation relative to the ground as shown in FIG. 5*a* and FIG. 5*b* for moving the goal assembly horizontally. Other suitable methods of mounting the goal assembly 21 can be used.

Figure 6:
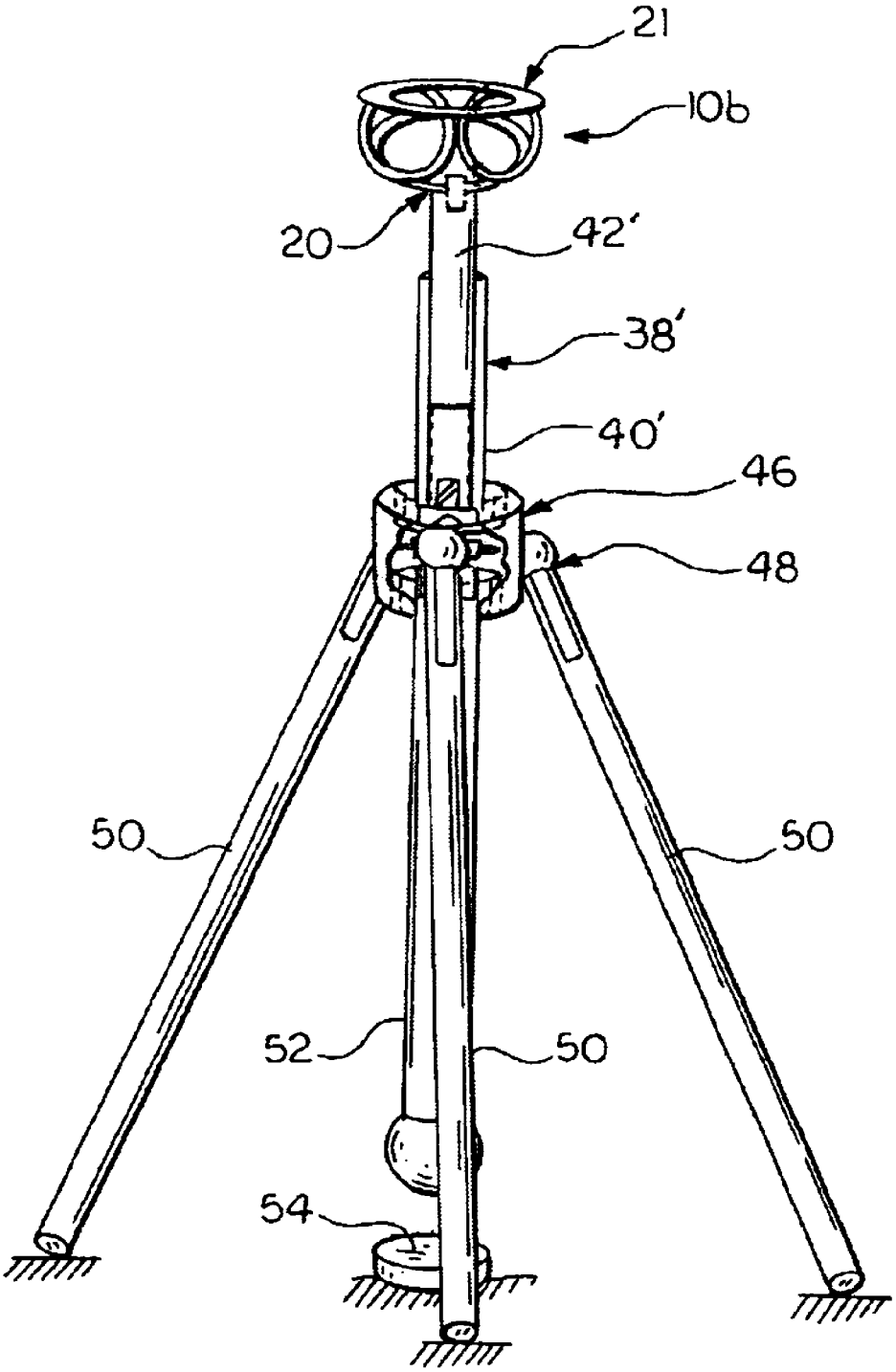
FIG. 6 (PRIOR ART)

Referring now to FIG. 6, a training apparatus 10*b* is shown having the goal assembly 21 attached to an alternative embodiment of a telescoping pole 38'. The telescoping pole 38' includes an upper member 42' slidably received in a lower member 40'. The lower member 40' is attached to a rotatable support member 46. The rotatable support member 46 is preferably a ball-and-socket-type connection or the like. A plurality of spring loaded members 48 are attached to an exterior surface of the rotatable support member 46 and connect the rotatable support member 46 to a corresponding plurality of support legs 50. A bottom portion of each of the support legs 50 is operable to engage the ground or a playing surface. A pendulum 52 extends downwardly from a lower surface of the rotatable support member 46. The impact from a basketball striking the goal assembly 21 will move the pole 38' from the vertical rotating it about the support member 46. The pendulum 52 then will automatically restore the pole 38' to the vertical position. A magnet 54 can be provided to rest on the ground directly below the lower end of the pendulum 52 to attract the pendulum when it has been moved from vertical.

Figure 7:
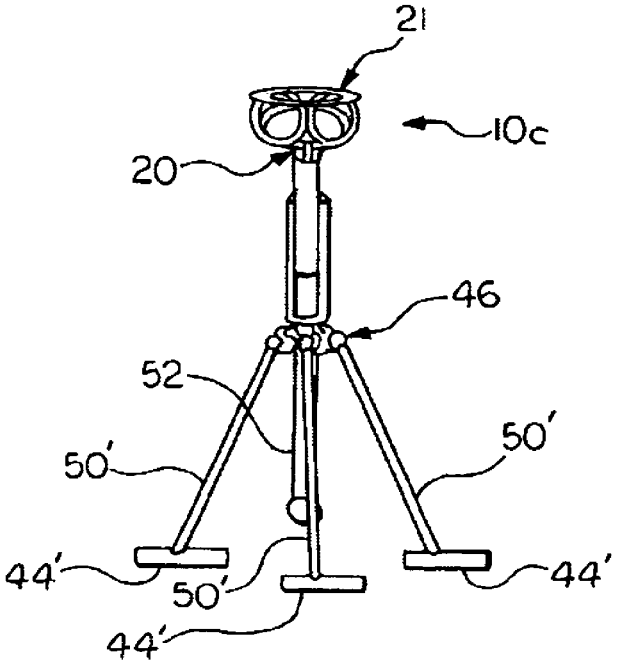
FIG. 7 (PRIOR ART)

Referring now to FIG. 7, a training apparatus 10*c* has the rotatable support member 46 attached to a plurality of alternative support legs 50'. The support legs 50' each include an individual support member 44' attached to a respective bottom portion thereof. The support members 44 and 44' can be formed as energy adsorbing bodies to dampen the force imposed by the ball contacting the goal assembly 21.

Figure 8:
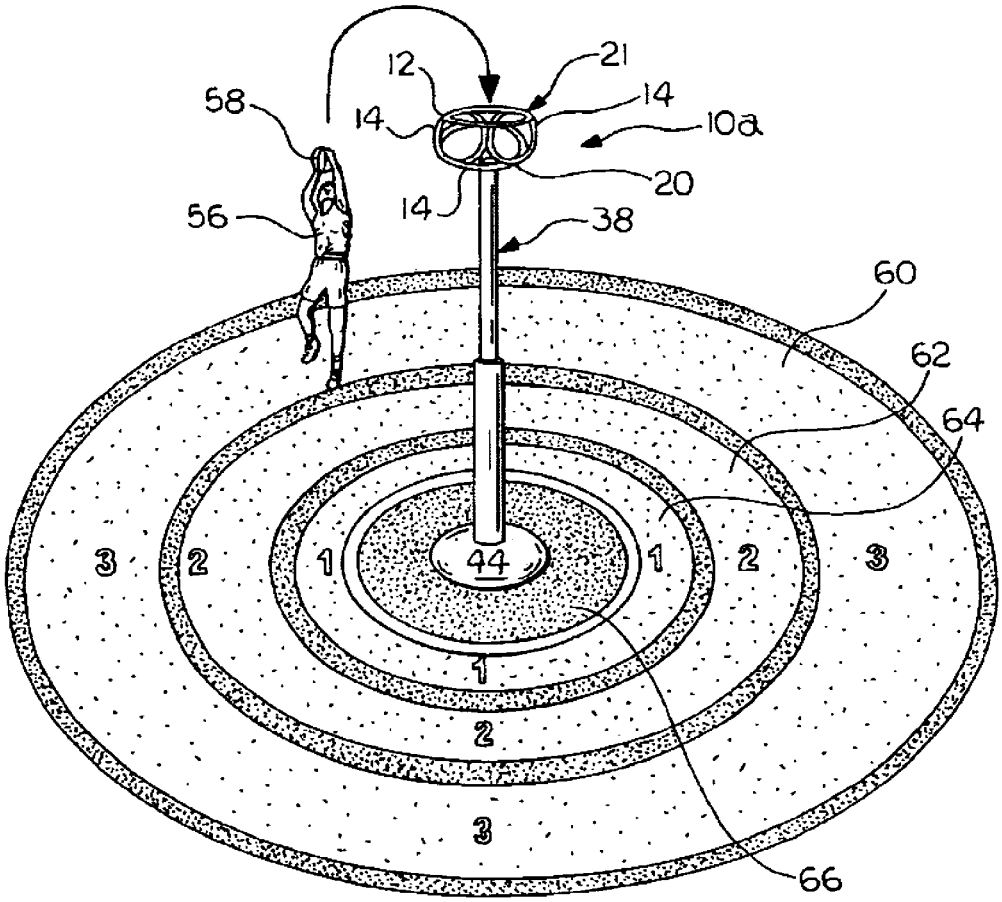
FIG. 8 (PRIOR ART)

Referring now to FIG. 8, the apparatus 10*a* is shown attached to the telescoping pole 38 of FIGS. 5*a* and 5*b*. In operation, a player 56 shoots a basketball 58 towards the goal assembly 21. If the shot is successful, the basketball 58 passes through the upper opening of the upper ring 12 and impacts the base member 20. The springs 34 and/or dampers 36 of the base member 20 absorb the force of the basketball 58 so that the basketball remains below the upper ring 12. The basketball 58 contacts the projection 26 which prevents the basketball from remaining in the goal assembly 21 and facilitates the exit of the basketball through a one of the lower openings in the lower rings 14. When the basketball 58 exits one of the lower openings, usually the player 56 is forced to move to retrieve the basketball and is in position to attempt another shot.

A method for using the training apparatus 10 (10*a*, 10*b* and 10*c*) can include the following steps:

providing the training apparatus according to the present invention;

providing the basketball 58 to the player 56;

allowing the player 56 to shoot the basketball 58 for a predetermined number of shots at the goal assembly 21; and tabulating a score based upon one or more of the number of successful shots per attempted shots, the number of successful shots made in a row, and which of the lower rings 14 that the basketball 58 exits the ring assembly 21.

Of course, the training apparatus 10, 10*a*, 10*b*, 10*c* can be used to play any of the known basketball game variations including the first player to make a predetermined number of shots and the first player to reach a predetermined number of points. Also, one or two of the lower rings 14 can be blocked, such as by a net or screen, to direct the return of the basketball through a selected another one of the lower rings. This configuration is useful for shooting free throws or practicing from a specific area.

As shown in FIG. 8, concentric rings can be designated about the support member 44, each having a different "made" shot value. For example, an outer ring 60 can have a made shot value of "3" points, an intermediate ring 62 can have can have a made shot value of "2" points, and an inner ring 64 can have a made shot value of "1" point. An area inside the inner ring 64 on which the support member 44 rests can be an out-of-bounds area 66. A "Radar Shot 21" game can be played by various combinations of players. For example, one to six players can participate in one on one play. Two teams of one to three players each or three teams of two players each can play the game. Typical basketball rules apply with the starting ball possession determined by a flip of a coin or the highest scoring designated shooter for each team. If a player steps into the out-of-bounds area 66, the ball is awarded to the other team. The ball may change hands after each successful shot, infraction or rebound. When the ball changes hands, ownership must be established outside the outer ring 60 or the ball is awarded to the other team and no points are recorded. If a team or a player scores more than twenty-one points, the point total is reduced to fifteen and possession of the ball is retained.

There is shown in FIG. 9 through FIG. 13 an embodiment of a goal assembly 70 according to the invention. The goal assembly 70 includes the upper ring 12 (shown in FIG. 1) attached to the three lower rings 14 according to the prior art goal assembly 21. If the rings 12, 14 are basketball rims, a standard size basketball net 72 hangs from the bottom of the upper ring 12 as is conventional. The prior art shock absorbing base member 20, shown in detail in FIG. 3 and FIG. 4, is replaced by a shock absorbing base 80 according to the invention. Opposite the upper ring 12, the lower rings 14 are attached to a base plate 74 that is suitable for attachment to the top of a support that positions the upper ring 12 above a playing surface.

Figure 9:
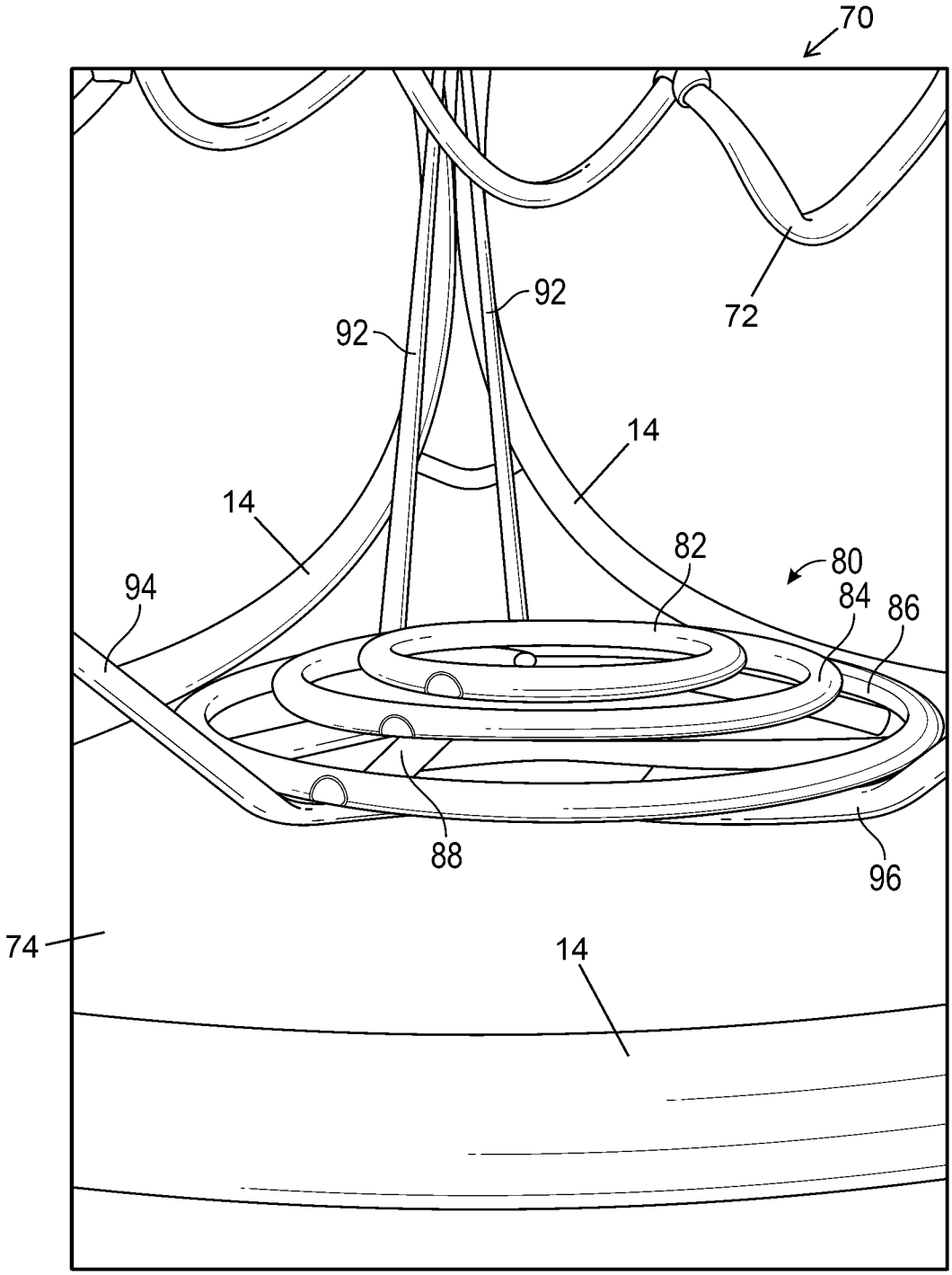
FIG. 9 is an enlarged perspective view of portion of a goal assembly according to the invention with an alternate embodiment shock absorbing base.
Figure 10:
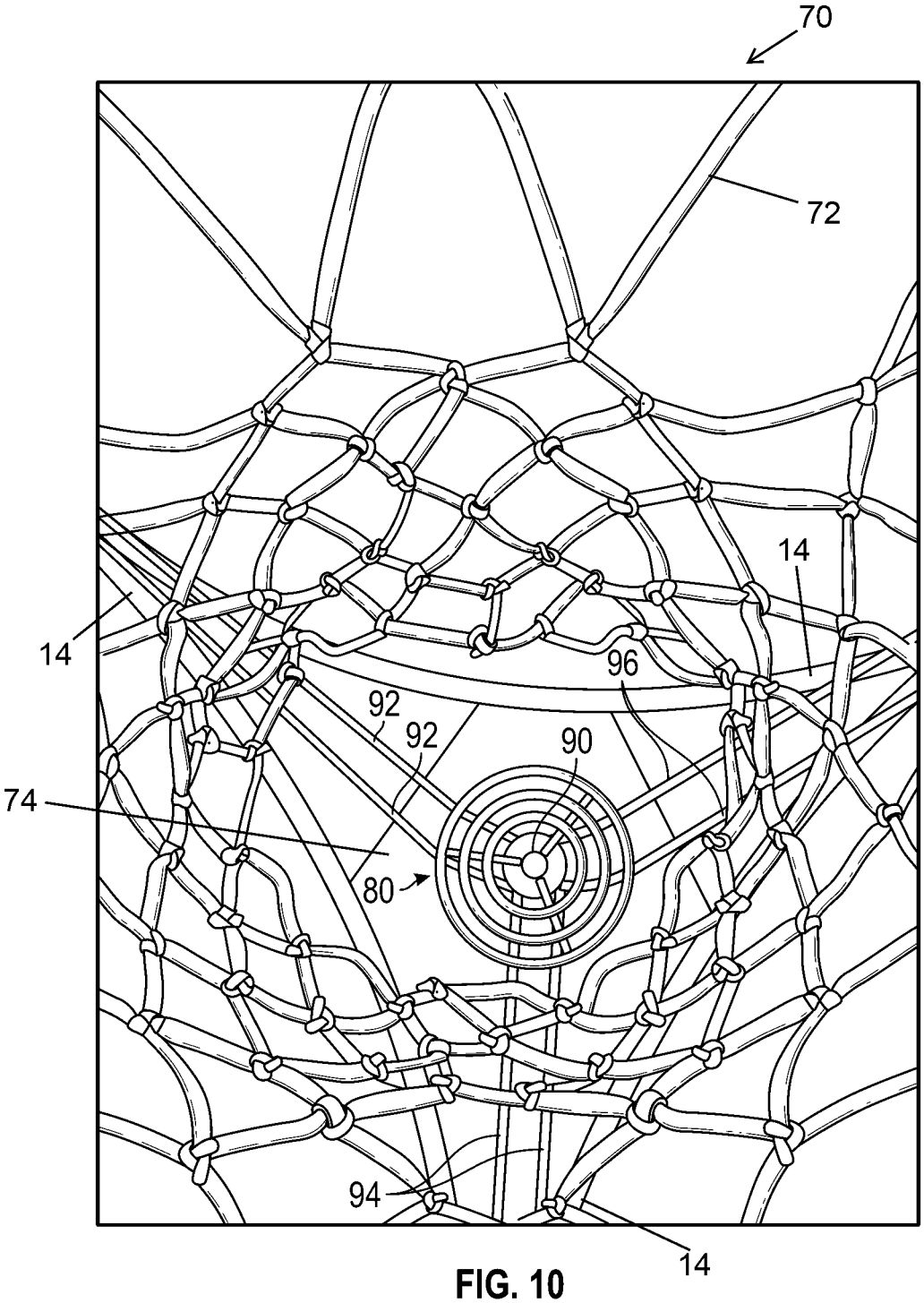
FIG. 10 is a plan view of the goal assembly shown in FIG. 9.

The shock absorbing base 80 includes three concentric rings 82, 84 and 86 of different diameters. The rings are vertically spaced with the smallest diameter first or top ring 82 being in a top position, the largest diameter third or bottom ring 86 being in a bottom position and the intermediate diameter second or middle ring 84 being in an intermediate position between the other rings. The rings 82, 84 and 86 are maintained in the shown concentric and vertical spaced relationships by three connector bars 88 each extending in a radial direction from a center point of the shock absorbing base 80. The connector bars 88 are equally spaced, and are positioned underneath and attached to the rings 82, 84 and 86 to form a rigid structure as best shown in FIG. 9 and FIG. 11.

Figure 11:
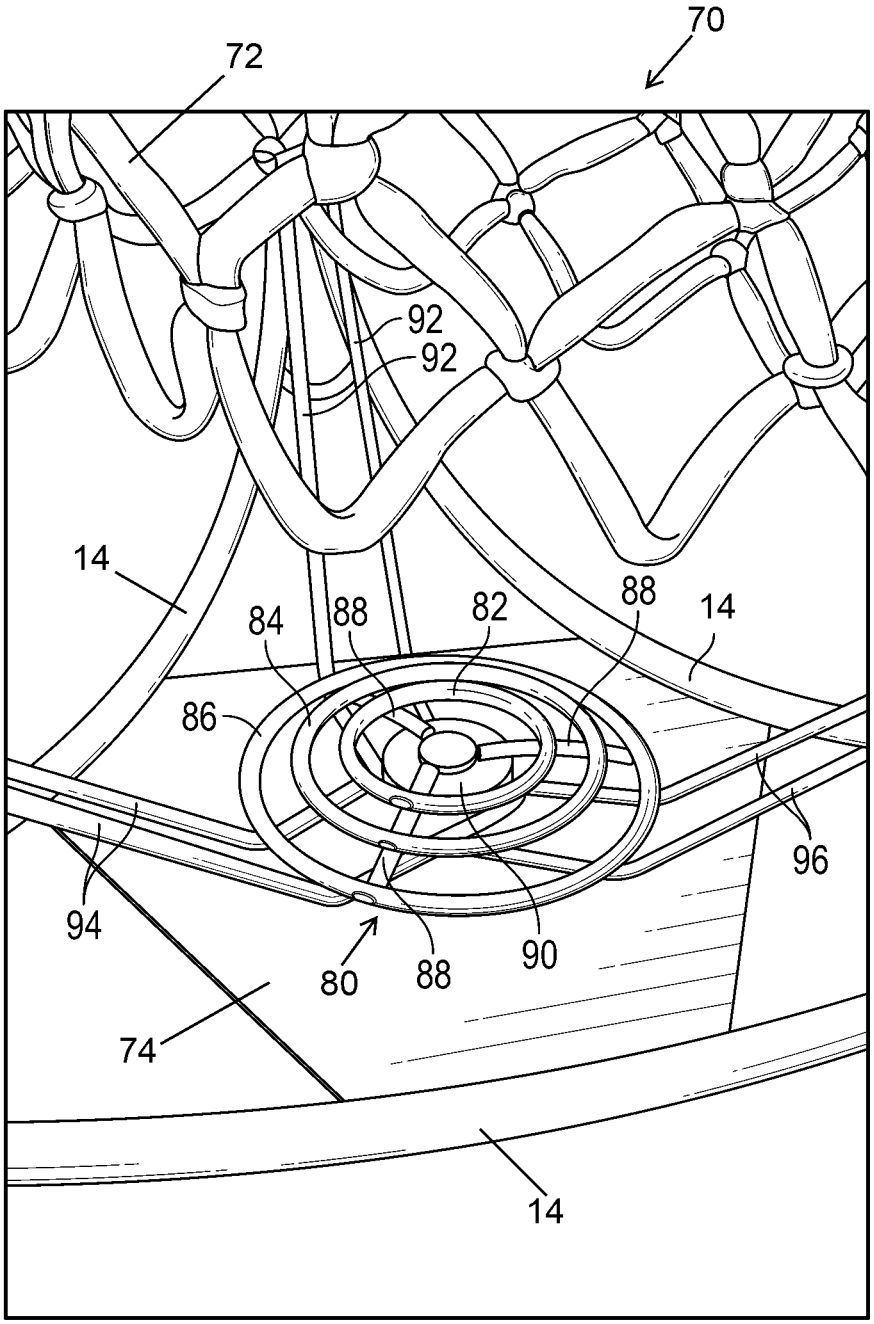
FIG. 11 is a view of the goal assembly similar to FIG. 9 but including the base member.
Figure 12:
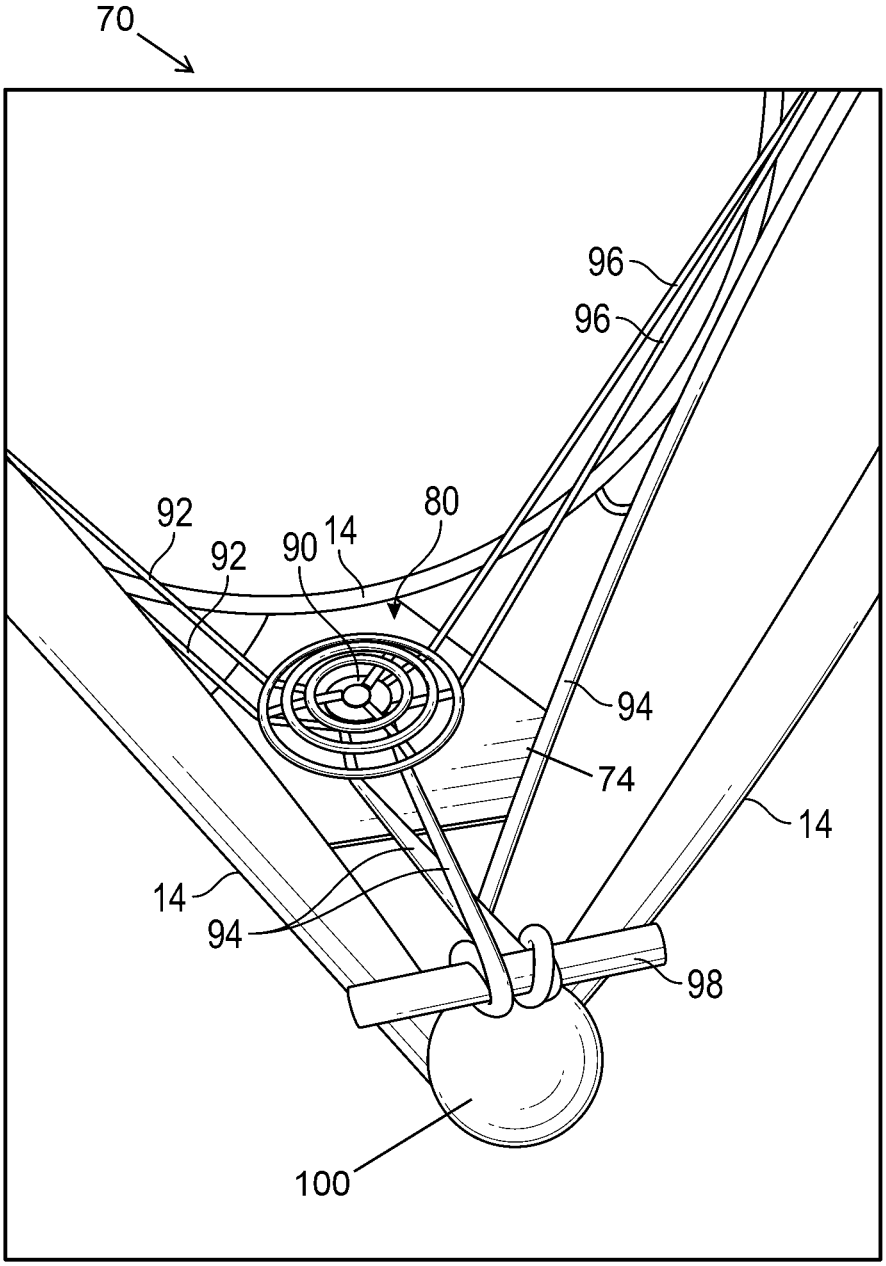
FIG. 12 is a perspective view of the goal assembly with a detail of the support for the shock absorbing base.
Figure 13:
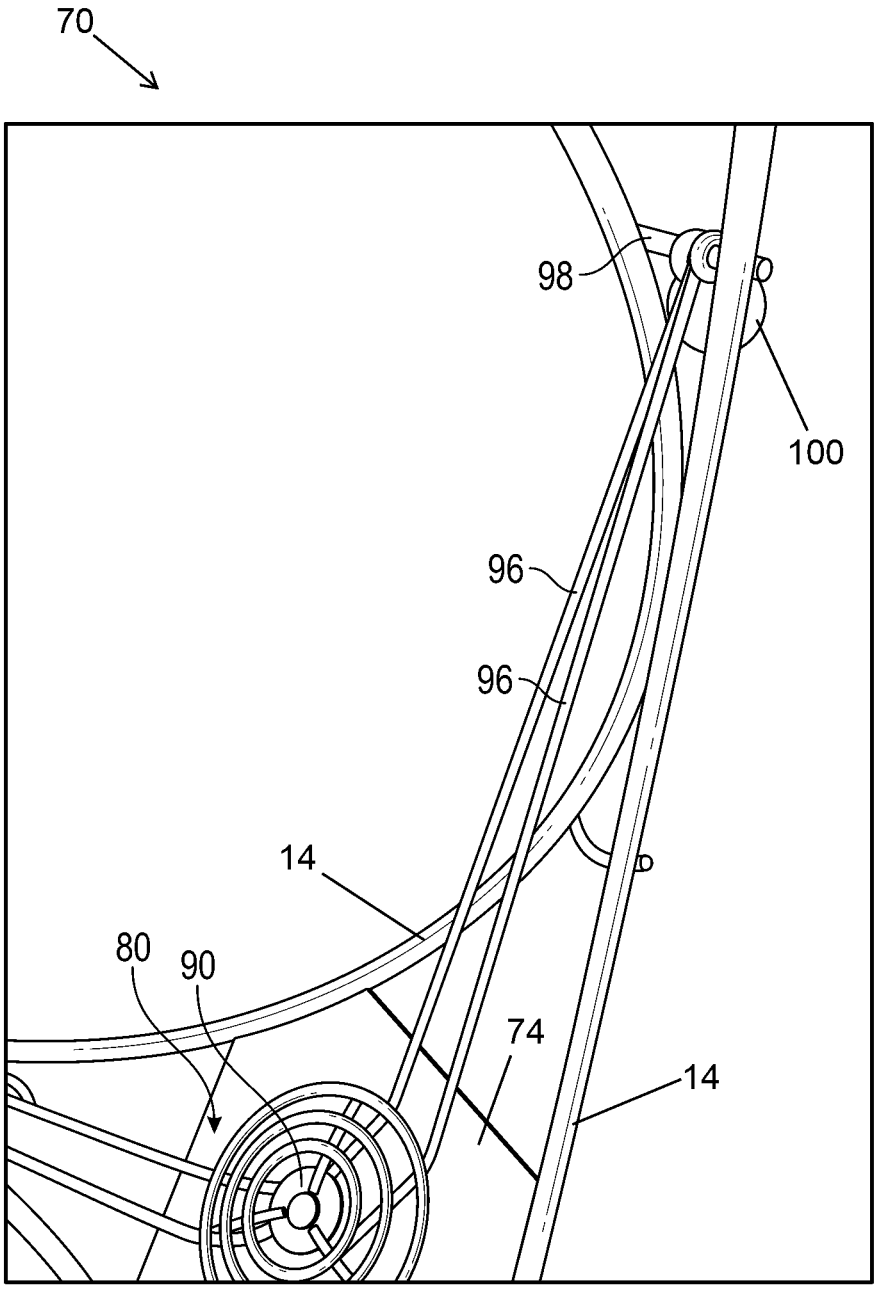
FIG. 13 is a perspective view of the goal assembly with a detail of the support for the shock absorbing base from a different angle than FIG. 12.

As shown in FIG. 11, the bars 88 terminate short of the center point of the shock absorbing base 80 in free ends that are attached to a top of a cylindrical winding drum 90. The top of the drum 90 is positioned below a top of the first ring 82 and a bottom of the drum 90 extends below a bottom of the third ring 86. Each of three elastic cords 92, 94 and 96 has a central portion wound on the drum 90 and ends that extend radially outwardly under the third ring 86 (FIG. 11) and upwardly to tie bars 98 attached to the rings 14 (FIG. 12 and FIG. 13). Each tie bar 98 extends horizontally and has opposite ends thereof attached to two adjacent ones of the lower rings 14. The free ends of each of the cords 92, 94 and 96 wrap around an associated one of the tie bars 98 and terminate in a holding ball 100 positioned on an outside of the goal assembly 70. The holding balls 100 are of a diameter sufficient to prevent them from passing through the opening formed by the tie bar 98 and the attach lower rings 14. Thus, the shock absorbing base 80 is suspended by the elastic cords 92, 94 and 96 above the base plate 74 for absorbing the shock of a ball entering the upper ring 12 and falling on the base 80. Note that instead of the three separate elastic cords 92, 94 and 96, a single elastic cord could be wound around the winding drum 90 and the tie bars 98.

When an object, such as a basketball, passes through the upper ring 12 and exits the net 72, the object will fall onto the shock absorbing base 80. The vertically spaced rings 82, 84 and 86 will redirect the object out of the goal assembly 70 through one of the rings 14. The object can pass through one of the rings 14 facing the player so that the object is returned close to the shot release point. The object may also pass through either of the other two rings thereby forcing the player to move laterally to retrieve the object in order to take another shot.

While the training apparatus according to the invention has been described mainly as a basketball training tool, it can be used with other types of balls, such as a football, for training purposes or for contests of shooting skill. In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. A goal assembly comprising:

an upper ring extending in a horizontal plane and having an upper opening for receiving an object from above the upper opening;

three lower rings each having a lower opening for passage of the object received from the upper opening, each of the lower rings being attached to the upper ring and extending inwardly and downwardly from the upper ring;

a base plate positioned below and attached to the lower rings;

a shock adsorbing base attached to and elastically supported by the lower rings, the shock absorbing base being positioned beneath the upper ring and suspended above the base plate by at least one elastic cord, wherein the shock absorbing base absorbs a portion of a force generated by the object falling from the upper opening and contacting the shock absorbing base and thereafter the shock absorbing base redirects the object through one of the lower openings;

wherein the shock absorbing base includes at least first and second rings, the first ring having a first diameter and being vertically spaced above and concentric with the second ring, and the second ring having a second diameter larger than the first diameter;

wherein the shock absorbing base includes a third ring being vertically spaced below and concentric with the second ring, the third ring having a third diameter larger than the second diameter;

wherein the shock absorbing base includes a plurality of connector bars each extending in a radial direction outwardly from a center point of the shock absorbing base, the connector bars being positioned underneath and attached to the first, second and third rings; and wherein the bars terminate short of the center point in free ends that are attached to a top of a cylindrical winding drum extending downwardly below the third ring.

2. The goal assembly according to claim 1 wherein the object is a basketball and the upper ring and the lower rings are basketball rims.

3. The goal assembly according to claim 1 wherein the upper ring and at least one of the lower rings are of a same diameter as a regulation basketball rim.

4. The goal assembly according to claim 1 wherein at least one of the lower rings is at least one of a different size and a different shape than the upper ring.

5. The goal assembly according to claim 1 wherein the at least one elastic cord is a plurality of elastic cords, each of the elastic cords wrapping around the winding drum and extending to an associated pair of the lower rings.

6. The goal assembly according to claim 1 wherein the at least one elastic cord is a plurality of elastic cords, each of the elastic cords extending between the shock absorbing base and an associated pair of the lower rings.

7. The goal assembly according to claim 6 including a plurality of tie bars, each of the tie bars being attached between the lower rings of one of the associated pairs of the lower rings, and wherein the elastic cords are each attached to an associated one of the tie bars.

8. The goal assembly according to claim 7 wherein each of the cords extends from the shock absorbing base under the third ring and upwardly to the associated pair of lower rings.

9. The goal assembly according to claim 1 including a support member adapted to attach to and support the base plate above a playing surface.

10. A goal assembly comprising:

an upper ring extending in a horizontal plane and having an upper opening for receiving an object from above the upper opening;

three lower rings each having a lower opening for passage of the object received from the upper opening, each of the lower rings being attached to the upper ring and extending inwardly and downwardly from the upper ring;

a base plate positioned below and attached to the lower rings;

a shock adsorbing base attached to and elastically supported by the lower rings, the shock absorbing base being positioned beneath the upper ring and above the base plate, wherein the shock absorbing base absorbs a portion of a force generated by the object falling from the upper opening and contacting the shock absorbing base and thereafter the shock absorbing base redirects the object through one of the lower openings;

wherein the shock absorbing base includes three concentric rings vertically spaced apart with a smallest diameter top ring being in a top position, a largest diameter bottom ring being in a bottom position and an intermediate diameter middle ring being in an intermediate position between the top ring and the bottom ring;

wherein the shock absorbing base includes a plurality of connector bars each extending in a radial direction outwardly from a center point of the shock absorbing base, the connector bars being positioned underneath and attached to the top, middle and bottom rings, the bars terminating short of the center point in free ends that are attached to a top of a cylindrical winding drum extending downwardly below the bottom ring;

a plurality of elastic cords, each of the elastic cords wrapping around the winding drum and extending to an associated pair of the lower rings;

a plurality of tie bars, each of the tie bars being attached between the lower rings of one of the associated pairs of the lower rings, and wherein each of the elastic cords extends from the winding drum, under the bottom ring and upwardly to an associated one of the tie bars; and a support member adapted to attach to and support the base plate above a playing surface.

* * * * *